US005199457A

United States Patent [19]

Miller

[11] Patent Number: 5,199,457

[45] Date of Patent: Apr. 6, 1993

[54] LEAK DETECTING SURFACE PROTECTOR

[76] Inventor: David R. Miller, 7373 SW. 25th, Portland, Oreg. 97219

[21] Appl. No.: 840,530

[22] Filed: Feb. 25, 1992

[51] Int. Cl.[5] ..... E03B 7/08; F16L 55/07

[52] U.S. Cl. ..... 137/312; 220/571; 222/108

[58] Field of Search ..... 4/613; 137/312, 602; 180/69.1; 220/571; 222/108

[56] References Cited

U.S. PATENT DOCUMENTS

| | | | |
|---|---|---|---|
| 1,088,783 | 3/1914 | Lisbae | 211/90 |
| 1,847,256 | 3/1932 | Nielsen | 34/90 |
| 2,334,779 | 11/1943 | Luff | 52/97 |
| 2,614,401 | 10/1952 | Roberts | 62/258 |
| 2,692,790 | 10/1954 | Tharrington | 296/3 |
| 2,954,875 | 10/1960 | Becker | 211/41 |
| 3,304,950 | 2/1967 | Hubert | 137/312 |
| 3,662,912 | 5/1972 | Calle | 206/557 |
| 3,895,398 | 7/1975 | Mustee | 4/613 |
| 4,169,638 | 10/1979 | Cirasuolo | 312/229 |
| 4,509,647 | 3/1985 | Shevchuk | 211/41 |
| 4,589,150 | 5/1986 | Sciabarassi | 4/656 |
| 4,679,590 | 7/1987 | Hergenroeder | 137/312 |
| 4,729,404 | 3/1988 | Hergenroeder | 137/602 |
| 4,765,360 | 8/1988 | Baird | 137/312 |
| 4,889,155 | 12/1989 | Trotter | 137/312 |
| 4,903,723 | 2/1990 | Sublett | 137/312 |
| 5,019,939 | 5/1991 | Reimer | 361/386 |

*Primary Examiner*—George L. Walton
*Attorney, Agent, or Firm*—John B. Dickman, III

[57] ABSTRACT

A device comprised of impervious material, sloping back to front, for collecting leakage from plumbing fixtures and waste and supply lines that will protect the surface on which said device is installed on or built into, such as but not limited to sink cabinetry and flooring underneath, from damage with an area at the front of the liquid collection receptacle for leakage accumulation and leakage detection, as well as providing a horizontal support surface to maintain storage capabilities.

10 Claims, 2 Drawing Sheets

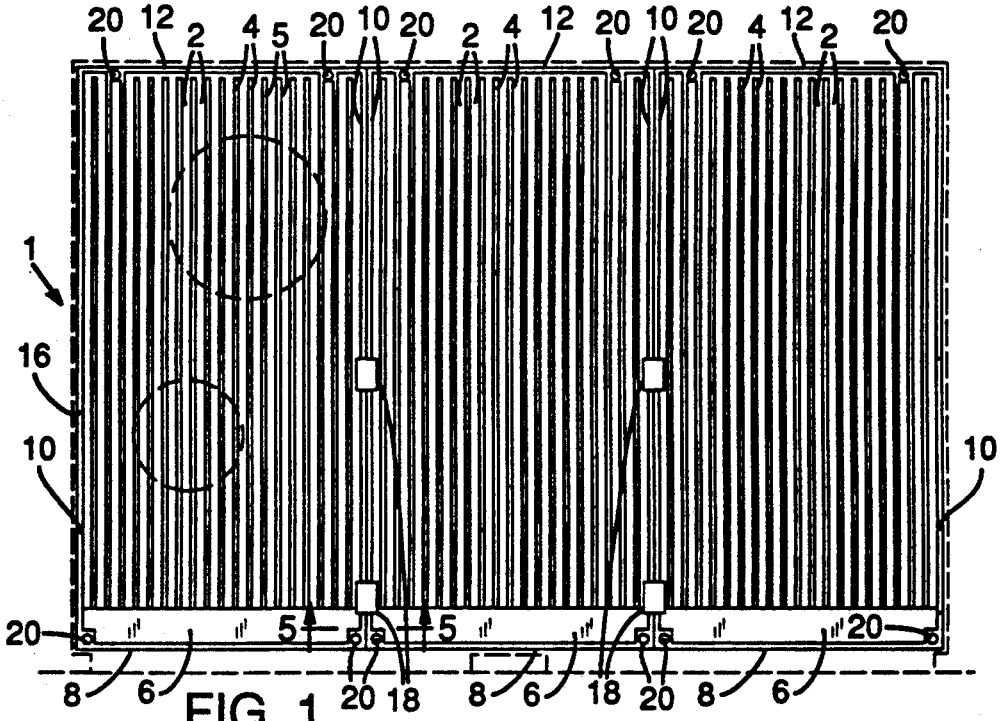
FIG. 1
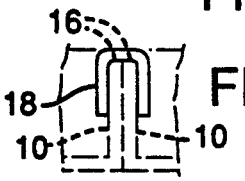
FIG. 5
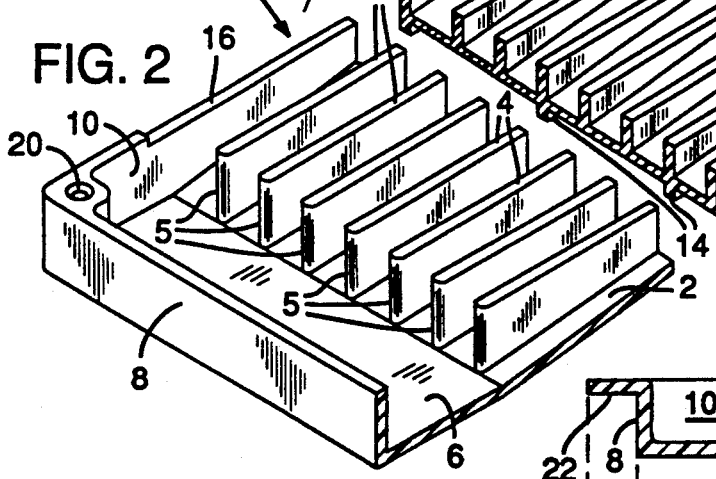
FIG. 2
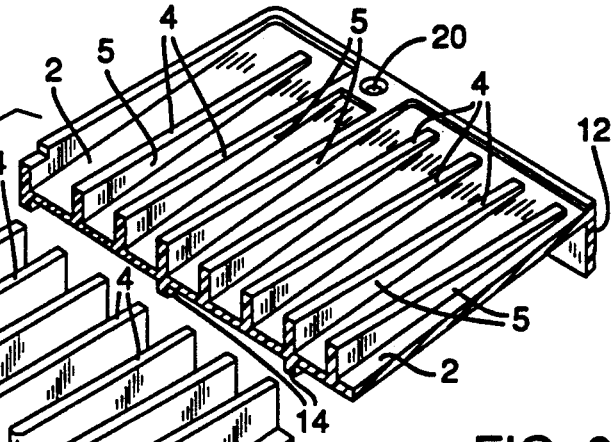
FIG. 6
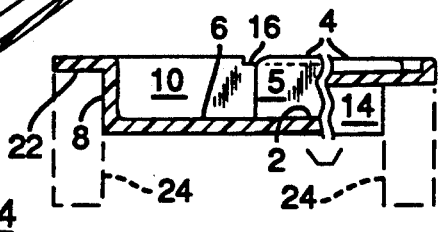
FIG. 3
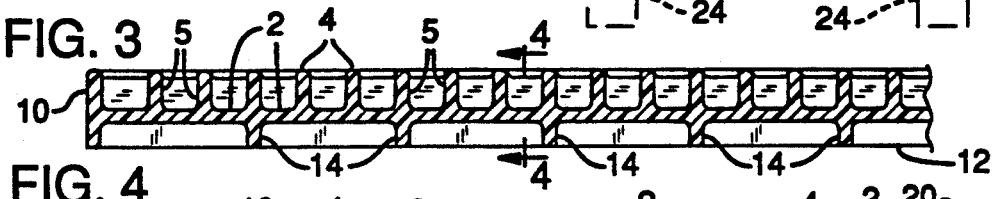
FIG. 4
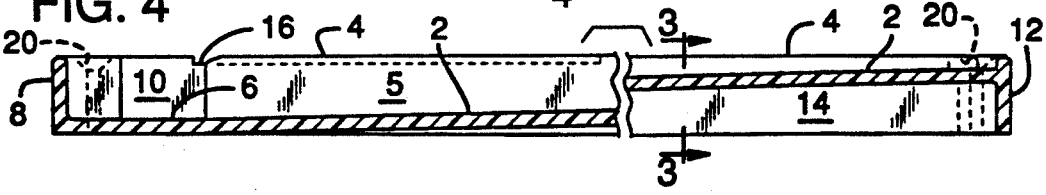

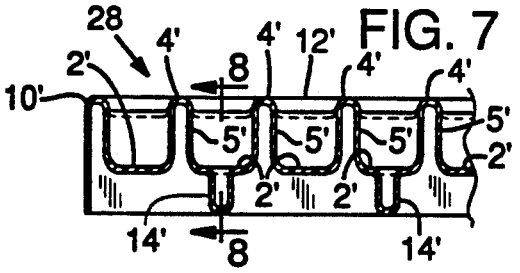
FIG. 7
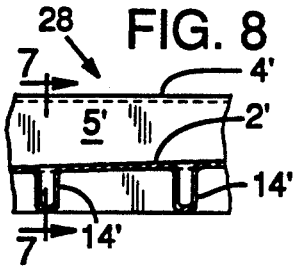
FIG. 8
FIG. 9
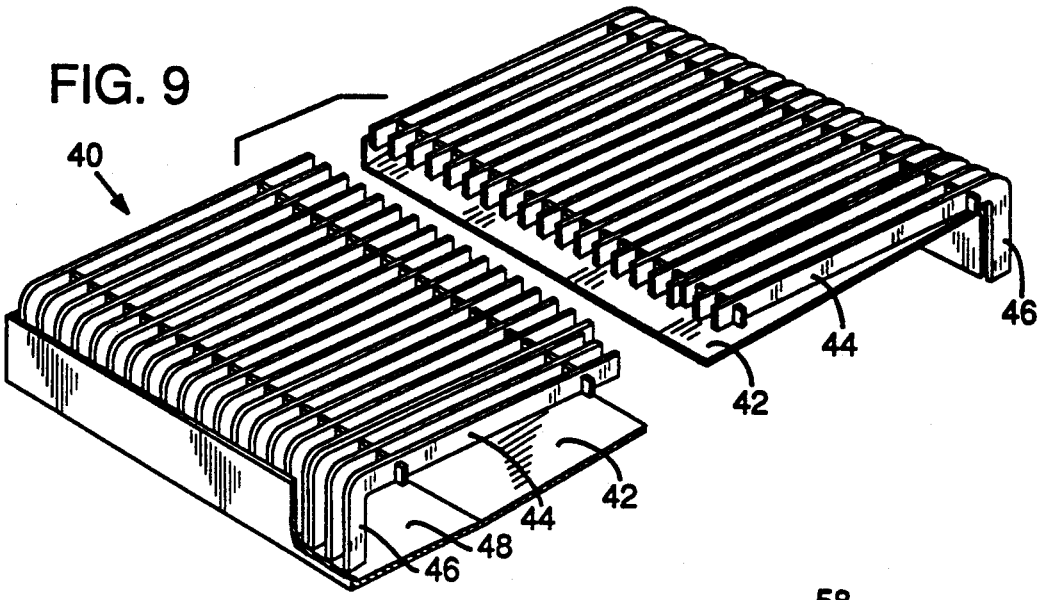
FIG. 10
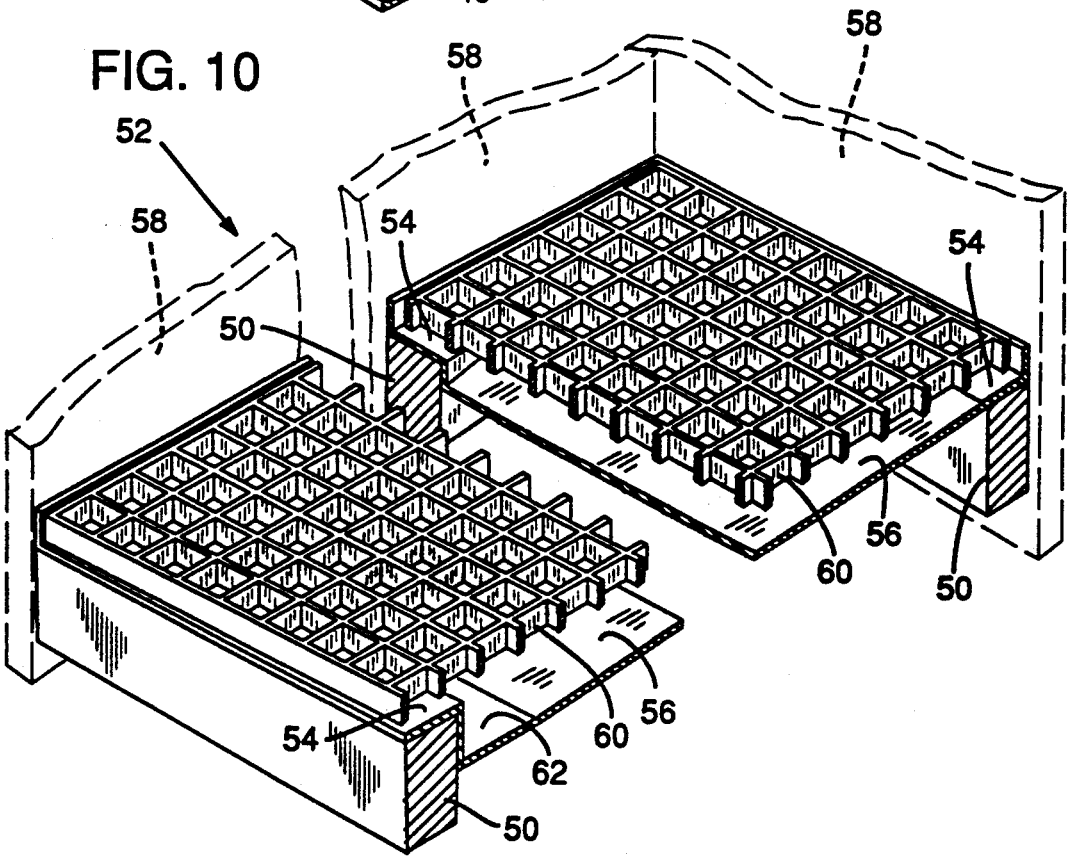

LEAK DETECTING SURFACE PROTECTOR

BACKGROUND OF THE INVENTION

1. Field of the Invention

This invention relates in general to leak detection and more specifically, to a device comprised of impervious material for collecting leakage from plumbing fixtures and waste and supply lines that will protect the surface on which it is installed or built into, such as but not limited to sink cabinetry and flooring underneath, from damage with an area at the front of the liquid collection receptacle for accummulation and detection of leaks, as well as providing a horizontal support surface to maintain storage capabilities.

Disclosure Document #293358 was filed with the U.S. Patent and Trademark Office, Oct. 11, 1991.

2. Description of Related Art

A problem commonly encountered with plumbing fixtures and garbage disposal drains is the failure of the water-tight seals and drain joints. Water and liquids may then leak onto the surfaces below. This type of leakage often goes on unnoticed for a length of time because of the recessed location of the pipes and the contents which are typically stored on the surface below said pipes which can obscure the visibility of the leak. Sometimes only a small quantity of liquid leaks from the pipes or drains and quickly penetrates into the surface below directly and/or seeps into crevices of the surfaces below, such as but not limited to sink cabinetry and flooring, so that even if the area were inspected periodically, there would be no visual signs of leakage. Over a period of time, the undetected leakage may cause considerable damage to surfaces and contents stored below, as well as the flooring underneath and possibly even damage to the building structures. The first signs of water and liquid leakage are often evident only after very costly damage has occurred causing considerable expenses to be incurred to repair the damage and replace structures.

The device can also be used to locate which of the water pipes or waste pipes is leaking. The spaces between the plurality of fins provide passages for the collecting fluid to travel down the sloped surface to the trough or liquid accummulation area; therefore, any leakage will be isolated to a specific few passages by the fins making it easier to detect the source of the leak.

The utility and spirit of the above prior art references, either individually or in combination, do not provide the novel utility and spirit of the elements of the present invention. The relevant references address only the leaking aspect while the present invention has added utility purposes. While these devices may be suitable for the particular purposes to which they address, they will not be as suitable for the purposes of this invention, as hereinafter will be described.

SUMMARY OF THE INVENTION

It is an object of this invention to provide a device for collection and detection of leakage from plumbing fixtures and waste and supply lines.

It is also an object of this invention to provide a device with a horizontal surface to preserve the storage capabilities of the surface on which it is installed or built into, such as, but not limited to, sink cabinetry.

It is a still further object of this invention to provide a device of impervious material to protect the surface on which it is installed or built into from damage caused by leakage.

In order to accomplish leak collection and leak detection, the device is to be provided with a sloping surface, back to front, which terminates in a liquid accummulation area at the front of the device for ease of detecting said leakage. To accomplish the horizontal surface to preserve the storage capabilities, the device is to be provided with a plurality of level fins either integrated into the sloping surface or temporarily insertable and removable, or an open grate or grillwork supported above the sloping surface which is insertable and removable. This horizontal surface will provide a support surface for articles and containers typically placed on the original surface. As well, this horizontal surface, being elevated from the sloped surface, will provide said articles with protection from possible damage from leakage. For ease of installation and removal for cleaning, the present invention may be constructed in a plurality of segments or units that can be attached to each other. This will provide a flexibility of width dimensions. The device may also have the capability to be attached to the surface or adapted with a perimeter flange and a means of self support for a built-in installation. The liquid accummulation area at the front of the device may optionally be provided with a moisture sensor device to enhance the leakage detection object of the invention. The invention can also be used to locate which of the water pipes or waste pipes is leaking. The spaces between the plurality of fins provide passages for the collecting water to travel down the sloped surface to the trough or liquid accummulation area, therefore, any leak will be isolated to a specific location by the fins making it easier to locate the leak, in one embodiment of the invention.

BRIEF DESCRIPTION OF THE DRAWINGS

FIG. 1 is a plan view of a plurality of devices comprised of a horizontal support surface and sloped liquid collection surface and a liquid accummulation and detection area attached together according to one embodiment of the present invention, with articles and containers set on the horizontal support surface shown by phantom lines in random locations;

FIG. 2 is a fragmentary isometric longitudinal and cross sectional view of one embodiment of the present invention;

FIG. 3 is a fragmentary cross sectional view of one embodiment of the present invention, taken along lone 3—3 of FIG. 4;

FIG. 4 is a fragmentary longitudinal sectional view of the present invention taken along line 4—4 of FIG. 3;

FIG. 5 is a cross sectional view of a possible attaching system for a plurality of devices taken along line 5—5 of FIG. 1;

FIG. 6 is a fragmentary longitudinal sectional view of another embodiment of the present invention taken along line 4—4 of FIG. 3 showing a flange added to the front wall, and the back wall is removed and reinforcing supports notched to allow the device to be built in, to replace a cabinet floor;

FIG. 7 is a partial sectional view taken along the line 7—7 of FIG. 8 showing a device formed by a plastic vacuum molding apparatus for manufacturing a device of the invention as in FIG. 1;

FIG. 8 is a partial sectional view taken along the line 8—8 of FIG. 7 showing a device formed by a plastic vacuum molding apparatus for manufacturing a device of the invention as in FIG. 1;

FIG. 9 is a fragmentary isometric longitudinal and cross sectional view of another embodiment of the present invention where an open grate is supported above the sloping surface;

FIG. 10 is a fragmentary isometric longitudinal and cross sectional view of another embodiment of the present invention where a horizontal open grate is supported above the sloping surface that is built into a cabinet structure, to replace a cabinet floor.

DETAILED DESCRIPTION OF THE INVENTION

Referring now to the drawings in greater detail, FIG. 1 through FIG. 5 illustrate the preferred construction of a device or tray 1 made of impervious material, preferably of plastic or rubber, in accordance with one embodiment of the present invention. The numeral 2 represents a sloping surface which slopes generally horizontal from back to front, to collect the leakage and direct it to a leak accummulation detection area 6 at the front of the device 1. Encompassing and supported at the perimeter of the sloping surface 2 is a front wall 8, two side walls 10, and a back wall 12. There are reinforcing supports 14 integral with the underneath side of the sloping surface 2. A plurality of fins 5 having horizontal surfaces 4, project upwardly from the sloping surface 2, and arranged in a parallel pattern to one another on the sloping surface 2, thereby allowing any leakage to reach the sloping surface 2. The fins 5 provide a horizontal support surface installed on or built into the device 1 to maintain the storage capabilities of a cabinet that the device 1 is installed on or built into. There are notches 16 in the side walls 10 to receive U-shaped clips 18 to provide an attachment system for maintaining a flat horizontal surface when a plurality of devices 1 are joined together as shown in FIG. 1. Optionally, the device 1 can be attached to a surface by screws (not shown) in reinforced openings 20 which may be provided. Reinforced openings 20 may be located at the junction of front wall 8 and side walls 10 and mid points of back wall 12.

Referring now to FIG. 6 which is similar to device 1 with a horizontal flange 22 added to front wall 8 and structural supports 14 notched to rest on cabinet structure support 24 for a built-in embodiment of the present invention which fits in a cabinet structure and replaces a cabinet floor.

Referring now to FIGS. 7 and 8 which show partial views of a vacuum formed plastic device 28 having side walls 10, an end wall 12 and a front wall 8 (only side wall 10 and end wall 12 are shown), a plurality of fins 5 with horizontal surfaces 4, and sloping bottoms 2 between the fins 5. Integral with sloping bottom 2 are reinforcing supports 14. There is also a leak accummulation detection area 6 (not shown) similar to the accummulation detection area 6 at the front of the device 1. The molded plastic device 28 is economically formed using a vacuum forming method well known in the plastics molding art.

Another embodiment of the invention is shown in FIG. 9, where there are no fins 5 or horizontal surfaces 4 on sloping surface 42. The device 40 has a separate horizontal open grate 44 with vertical supports 46 to support articles above as with device 1. There is a leak accummulation detection area 48 to collect any fluid leakage, visible through open grate 44.

Another embodiment of the invention is shown in FIG. 10 where there are no fins 5 or horizontal surfaces 4 on sloping surface 56. Device 52 shows a built-in embodiment of the invention which fits within cabinet walls 58 and replaces the cabinet floor of a cabinet structure. Shown are cabinet structural supports 50 and a tray device 52 of the invention. The device 52 is similar to device 1 except there are flanges 54 which can be fastened to cabinet supports 50. The device 52 has a separate horizontal open grate 60 that is supported on flanges 54. There is also a leak accummulation detection area 62 similar to the accummulation detection area 6 at the front of the device 1 which is visible through the horizontal open grate 60.

To use the tray device to detect which of the plumbing fixture lines is leaking, the device is placed in a cabinet housing a sink and its plumbing fixtures. The device is positioned either temporarily or permanently on cabinet supports used to house household cleaning supplies, etc., which is the more common area to find such items. When the device is positioned, the household supplies are returned to the cabinet, except they are now placed on the horizontal surface 4, above the sloping horizontal surface 2. The sloping horizontal surface 2 collects any fluid leakage, and by gravity, the fluid runs down the sloping surface to the accummulation and detection area 6 where it collects.

The device 1 being provided with fins 5 that are spaced along the sloping horizontal surface 2 to guide fluid leakage to accummulation and detection trough 6 has the further advantage of isolating which plumbing fixture is leaking. The leaking fluid drips onto the device 1 striking in a specific area, therefore, it is trapped between certain fins 5 and runs down a particular location on the sloping horizontal surface 2 to trough 6. A track of moisture is left on sloping surface 2 which points to the exact location of the leak. The use of the device 1 not only prevents damage to the cabinet surface, but it provides a quick and simple to use method of finding a fluid leak.

From the foregoing it will be seen that this invention is one well adapted to attain all the ends and objects hereinabove set forth together with other advantages which are obvious and which are inherent to the structures.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

While a preferred embodiment of the invention has been described in detail, it will be apparent that modifications and alterations may be made therein without departing from the spirit and scope of the invention set forth in the appended claims.

What is claimed is:

1. A tray device for collecting and detecting fluid leakage from plumbing fixtures and waste and supply lines comprising:

a tray structure having a sloping horizontal surface surrounded by side walls, a back wall and a front wall, said sloping horizontal surface extending downwardly from said back wall to said front wall;

an accummulation and detection trough at the bottom of said sloping horizontal surface to receive any fluid leakage collected on said sloping horizontal surface and running down said surface to said trough; and a plurality of spaced parallel fins on said sloping horizontal surface, said fins extending from said back wall to said accummulation and detection trough where said fins have horizontal surfaces for receiving and supporting articles above said sloping horizontal surface, whereby any fluid leakage is collected between said fins on said sloping horizontal surface, thereby locating a leaking plumbing fixture above the point where a fluid leakage is isolated between certain fins and runs down said sloping horizontal surface to said trough.

2. A tray device as in claim 1 wherein said sloping horizontal surface having a top side and a botton side, and a plurality of reinforcing support means integral with said bottom side.

3. A tray device as in claim 2 wherein said tray device having reinforcing where said side walls meet said front wall and mid points of back wall, said reinforcements having aperatures for receiving fastener means to secure said tray to a cabinet support surface.

4. A tray device as in claim 2 wherein said front wall and said backwall have horizontal flange means to fasten said tray device in a cabinet in place of a cabinet supporting surface.

5. A tray device as in claim 4 wherein said tray device is molded from a material including a rubber composition and a plastic composition.

6. A tray device as in claim 3 wherein said tray device is molded from a material including a rubber composition and a plastic composition.

7. A tray device as in claim 2 wherein said tray device is molded from a material including a rubber composition and a plastic composition.

8. A tray device for collecting and detecting fluid leakage from plumbing fixtures and waste and supply lines comprising:

a tray structure having a sloping horizontal surface surrounded by side walls, a back wall and a front wall, said sloping horizontal surface extending downwardly from said back wall to said front wall;

an accummulation and detecting trough at the bottom of said sloping horizontal surface to receive any fluid leakage collected on said sloping horizontal surface and running down said surface to said trough; and a horizontal open grate means extending above said sloping horizontal surface, said horizontal open grate means having a first end and a second end, vertical support means extending downwardly from said first and second ends to support said horizontal open grate above said sloping horizontal surface to receive and support articles on a cabinet surface.

9. A tray device as in claim 8 wherein said tray device having reinforcing where said side walls meet said front wall and mid points of said back wall, said reinforcements having aperatures for receiving fastener means to secure said tray to a cabinet support surface.

10. A tray device for collecting and detecting fluid leakage from plumbing fixtures and waste and supply lines comprising:

a tray structure having a sloping horizontal surface used in place of a cabinet floor, surrounded by two side walls, a front wall and terminating in a flange at the back end, said front wall and said side walls bent horizontally at a 90° angle across a cabinet floor structure which supports the said front, sides and back of the device, said sloping horizontal surface extending downwardly from said back flange to said front wall;

an accummulation and detecting trough at the bottom of said sloping horizontal surface to receive any fluid leakage collected on said sloping horizontal surface and running down said surface to said trough; and a horizontal open grate means spanning above said sloping horizontal surface, said horizontal open grate means supported vertically by said supporting structure covered by said front wall, said side walls, and said back flange, said horizontal open grate means above said sloping horizontal surface to receive and support articles typically placed on a cabinet surface.

* * * * *